United States Patent [19]

Paz

[11] Patent Number: 4,777,680

[45] Date of Patent: Oct. 18, 1988

[54] MUSICAL POTTY CHAIR

[76] Inventor: Lirida Paz, 815 Summer St., Elizabeth, N.J.

[21] Appl. No.: 508,573

[22] Filed: Jun. 28, 1983

[51] Int. Cl.[4] ..... A47K 11/00

[52] U.S. Cl. ..... 4/484; 4/483; 116/67 R

[58] Field of Search ..... 4/314, 315, 449, 479, 4/483, 484, 452; 340/573; 116/67 R

[56] References Cited

U.S. PATENT DOCUMENTS

| | | | |
|---|---|---|---|
| 1,286,516 | 12/1918 | Bowron | 4/479 |
| 2,535,704 | 12/1950 | Snyder et al. | 4/239 X |
| 2,663,861 | 12/1953 | Heath | 4/449 |
| 2,699,139 | 1/1955 | Mackey | 116/67 R |
| 2,721,531 | 10/1955 | Findley | 116/67 R |
| 2,788,764 | 4/1957 | Headlee | 116/67 R |
| 2,802,444 | 8/1957 | Gilmour | 116/67 R |
| 3,020,528 | 2/1962 | Swanson et al. | 4/449 X |
| 3,059,608 | 10/1962 | Lee | 116/67 R |
| 3,172,390 | 3/1965 | Garthofner | 116/67 R |
| 3,249,950 | 5/1966 | Wilson | 4/452 |
| 3,268,916 | 8/1966 | Hix | 116/67 R X |
| 3,364,478 | 1/1968 | DeeWaard | 116/67 R X |
| 3,680,151 | 8/1972 | Boardman et al. | 4/483 X |
| 3,691,980 | 9/1972 | Shastal | 116/67 R |
| 4,162,490 | 7/1979 | Fu et al. | 4/449 X |
| 4,174,544 | 11/1979 | Furusawa | 4/457 X |

FOREIGN PATENT DOCUMENTS

| | | | |
|---|---|---|---|
| 18469 | 9/1969 | Australia | 4/483 |
| 2359936 | 6/1974 | Fed. Rep. of Germany | 4/483 |
| 1028696 | 5/1953 | France | 116/67 R |

*Primary Examiner*—Charles E. Phillips
*Attorney, Agent, or Firm*—James M. Trygg

[57] ABSTRACT

A musical potty chair is disclosed having a novel mechanism for effecting operation of a music box upon elimination into a receptacle by a child using the device.

9 Claims, 1 Drawing Sheet

MUSICAL POTTY CHAIR

BACKGROUND OF THE INVENTION

This invention relates to childrens' potty chairs and more particulary to such devices having a mechanism for sounding musical tones upon use by the child.

There are various musical potty chairs in the prior art, most of which utilize a commercially available music box mechanism for producing the desired musical tones. Some devices are battery operated, see for example, U.S. Pat. No. 3,691,980, issued Sept. 19, 1972 to Shastal, while others are spring actuated, as is the music box of the present invention. All of these devices, however, provide a spring based pivoting support for the potty. The support is usually arranged so that when the child eliminates, the additional weight of the excrement in the potty causes the support to undergo pivotal movement in opposition to the spring. This pivotal movement then causes a member to disengage the escapement mechanism of a music box to enable it to operate. The moving parts of these devices, especially the potty, comprise a substantial mass, the inertia of which must be overcome, including static friction of the mechanism, solely by the small weight of the child's excrement. The mechanism, therefore, must be finely balanced and have low fricton bearings at all pivot points. Another type potty chair is disclosed in U.S. Pat. No. 2,663,861 issued Dec. 22, 1953 to Heath. In Heath a battery operated bell ringer is used instead of a music box. Two closely spaced electrical contacts are shorted by the presence of urine in the bottom of the potty thereby establishing a conductive path between the battery and the bell ringer. Another embodiment of Heath includes a yieldable portion of rubber arranged in the bottom of the potty directly over an electrical switch. It is intended that the weight of the excrement will deform the rubber portion and actuate the switch, thereby establishing the conductive path between the battery and the bell ringer.

SUMMARY OF THE INVENTION

According to the present invention there is provided a musical potty chair having a seat, musical means for sounding musical tones upon actuation thereof, and a receptacle means removably attached thereto for receiving excrement. The receptacle means includes a frame and a liner for forming a liquid containing membrane within the frame. A platform is provided having an upper surface for supporting the bottom of the liner. The platform is arranged to undergo linear movement in an upward direction and a downward direction. Resilient means is provided for urging the platform and the bottom of the liner in the upward direction to a position of equilibrium. An actuation means is responsive to the movement in a downward direction of the platform for actuating the musical means when the platform is not in the position of equilibrium. Upon deposit of excrement into the liner, the platform is urged downwardly in opposition to the resilient means thereby causing the musical means to sound musical tones.

DESCRIPTION OF THE PREFERRED EMBODIMENT

Figure 1:
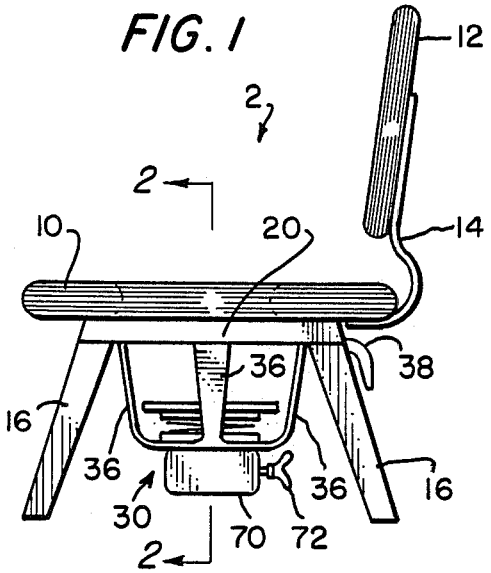
FIG. 1 is a side view of a child's potty chair embodying the teachings of the present invention.
Figure 2:
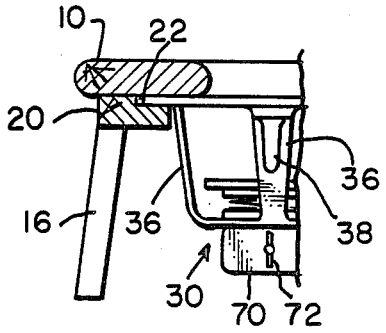
FIG. 2 is a partial sectional view taken along the lines 2—2 shown in FIG. 1.

There is shown in FIG. 1 a child's potty chair 2 having a seat 10, a back rest 12, a pair of supporting brackets 14 for supporting and positioning the back rest with respect to the seat, and four legs 16 for supporting the chair. The brackets 14 and legs 16 are attached in the usual manner by suitable screw fasteners, not shown, or other similar fasteners. A pair of guide rails 20 are attached with suitable screw fasteners to the underside of the seat 10, as shown in FIGS. 1 and 2. Each rail 20 has an undercut 22 formed longitudially in its top surface and facing inwardly toward the center of the chair, the two undercuts being substantially parallel for their entire lengths.

Figure 3:
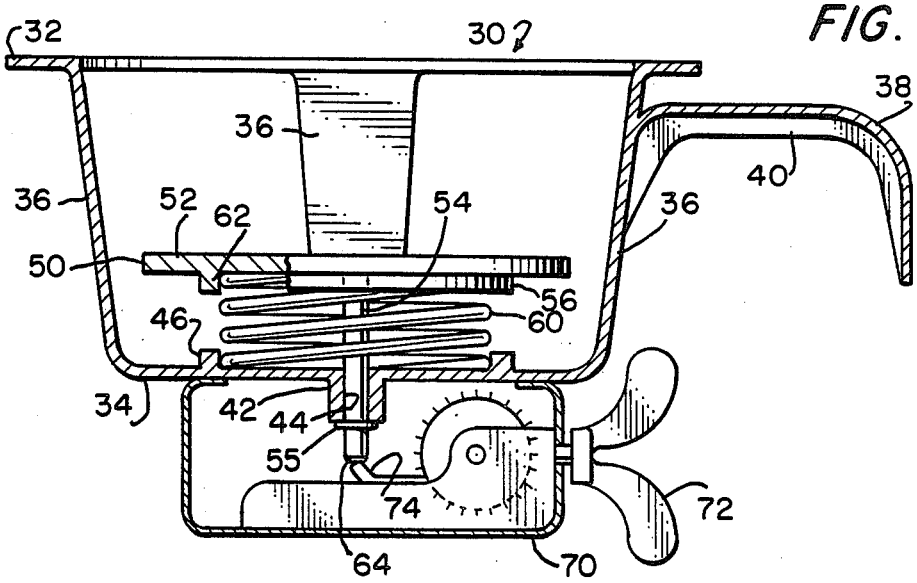
FIG. 3 is a side elevation sectional view of the potty and related mechanism shown in FIG. 1.

A potty or receptacle 30 is shown in FIG. 3 and includes a circular rim or flange 32, a bottom 34, and three or four vertically disposed ribs 36 connecting the flange 32 to the botton 34, forming a rigid basket like structure. An outwardly projecting handle 38 is formed integral with one of the ribs 36 just below the flange 32, and is strengthened by an integrally formed rib 40. The bottom 34 includes a boss 42 formed therein having a central hole 44 arranged substantially perpendicular to the upper surface 33 of the flange 32. An annular wall 46 formed in the bottom 34 of the receptacle 30 and projecting vertically upwardly is arranged substantially concentric to the hole 44.

A disc 50 having a top surface 52 which may be either flat or concave upward is disposed within the basket like structure of the receptacle 30 as shown in FIG. 3. A cylindrically shaped pin 54, the major axis of which is arranged perpendicular to the top surface, is, rigidly attached to the center of the disc 50 and projects downwardly and through the hole 44. The pin 54 and the hole 44 are sized to permit unrestrained vertical movement of the pin within the hole without an appreciable amount of side movement of the pin. Suitable materials should be chosen for the pin 54 and the base 42 which will permit this movement without galling or sticking in any way. Most thermosetting plastics having a hard, slick, outer surface will work well.

A retaining ring 55 is attached to the pin 54 in the usual manner for limiting upward movement of the pin 54 and the disc 50 thereby rendering the disc and pin captive to the receptacle 30. This will prevent disengagement of the parts should the receptacle 30 be inverted for any reason. An annular wall 56 formed in the lower surface of the disc 50 and projecting downwardly is arranged vertically above and in alignment with the wall 46.

A helical compression spring 60 is disposed between the bottom 34 of the receptacle 30 and the disc 50 and is arranged to apply light upward pressure on the disc sufficient to support its weight and that of the pin 54 thereby maintaining the disc 50 at a point of equilibrium. The disc is free to move in either an upward or downward direction upon the application of a suitable additional force. The two ends of the spring 60 loosely engage the inner surfaces 62 of the annular walls 46 and 56 to limit transverse movement of the spring. There are other suitable structures for limiting the transverse movement of the spring that will be readily apparent to those skilled in the art, and may be utilized in place of the two annular walls. Additionally, a spring of a different type or shape than that of the spring 60 could be used to support the vertical weight of the disc 50 and the pin 54. Such a spring could be of the flat or leaf type, suitably shaped, and arranged to engage the end 64 of the pin 54, urging it upwardly as viewed in FIG. 3. In this case the two annular walls would not be needed. While many similar suitable structures for supporting the weight of the disc 50 and the pin 54 will occur to one skilled in the art, the perferred structure is that shown in FIG. 3. It should be understood that the spring 60 is constructed so that it will support the weight of the disc 50, the pin 54, and the weight of a liner, to be described below, yet should an additional relatively small weight be included, the spring 60 would compress a substantial amount in response thereto.

A commercially available music box 70 is attached to the underside of the bottom 34 as shown in FIG. 3. Suitable screw fasteners or rivets may be used for this purpose. The music box 70 is of the spring drive type having a external key 72 for manually winding the spring motor. A lever 74 has one end that operationally engages the escapement mechanism, not shown, of the music box and another end that is adjacent and lightly touching the end 64 of the pin 54. The lever 74 is arranged so that it blocks operation of the spring motor of the music box so long as the end only lightly touches the end 64 of the pin 54, as shown in FIG. 3. If the end 64 of the pin 54 is made to depress the lever 74 a specific amount, the lever will disengage the escapement mechanism permitting the spring motor to operate thereby operating the music box.

Figure 4:
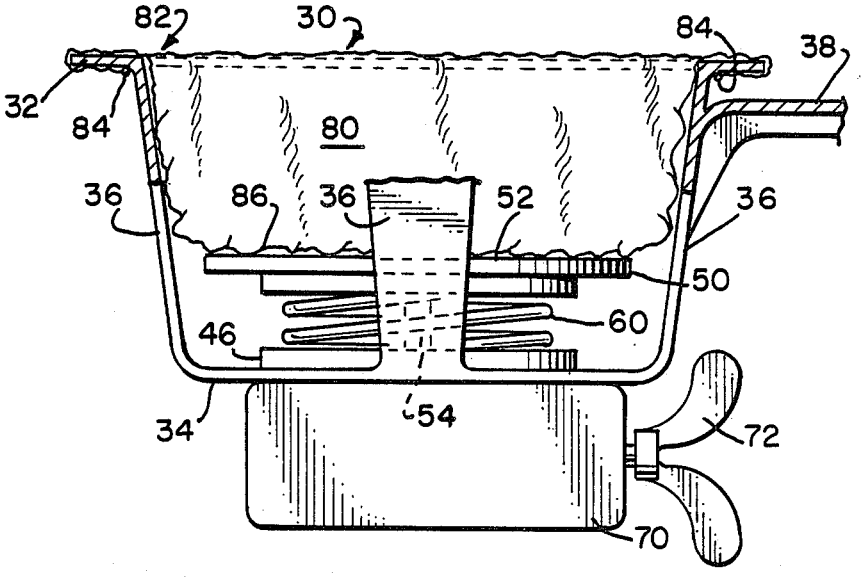
FIG. 4 is a view similar to that of FIG. 3, showing a pottyliner disposed therein.

The receptacle 30 is shown in FIG. 4 having a thin plastic liner 80 arranged within the basket like structure. The plastic liner 80 is open at the top 82 and has a drawstring 84 encircling the opening. The upper most part of the liner 80 is folded outwardly, over the flange 32, and then under the flange whereupon lower portion of the drawstring 84 is tightened to upper portion of the liner 80 securely in place. The botton 86 of the liner 80 rests upon the top surface 52 of the disc 50. The liner 80 is constructed of a very thin, light weight plastic sheet material and, as such, will exert an almost insignificant amount of downward pressure on the disc 50. However, the spring 60 should be chosen so that it will support the small additional weight of the liner 80 as well as that of the disc 50 and the pin 54.

In operation, a fresh liner is placed in the receptacle 30 as shown in FIG. 4, the spring motor of the music box 70 fully wound, and the receptacle 30 assembled into position under the potty chair as shown in FIG. 1. As the child using the potty chair eliminates into the lined receptacle, the weight of the excrement is added to the combined weights of the liner 80, disc 50, and pin 54 being opposed by the spring 60. As this added weight of the excrement becomes sufficient to overcome the inertia and static fricton of the disc, pin, and spring structures, the disc 50 will begin to move downwardly, as viewed in FIG. 3, against the opposing force of the spring 60. The end 64 of the pin 54, will move downwardly concurrently with the downward movement of the disc 50, thereby depressing the lever 74. This causes the end of the lever 74 to disengage the escapement mechanism thereby causing the music box to operate.

It is pointed out that an advantage of the structure of the present invention is that the number and mass of the moving parts required to actuate the music box in response to the weight of the child's excrement is minimized. This in turn minimizes the combined friction and inertial forces that must be overcome by the small additional weight of the excrement thereby providing a more sensitive and reliable musical potty chair.

Accordingly, there has been disclosed a musical potty chair having a novel mechanism for reliably actuating a music box. It is understood that the above described embodiment is merely illustrative of the application of the principles of this invention. Upon reviewing the present disclosure numerous other embodiments may be devised by those skilled in the art without departing from the spirit and scope of this invention, as defined by the appended claims.

I claim:

1. In a musical potty chair having a seat attached thereto for supporting the weight of a child and musical means for sounding musical tones upon actuation thereof, a receptacle means removably attached thereto for receiving excrement including feces and urine and being responsive to the weight of said excrement exclusive of said weight of said child for effecting said actuation of said musical means comprising:

(a) a frame;

(b) a liner means for forming a liquid containing membrane within said frame, said liner means having a lower portion and an upper portion, said upper portion being supported by said frame;

(c) a platform means having an upper surface for supporting said lower portion of said liner means, wherein said platform is arranged to undergo linear movement in an upward direction and a downward direction with respect to said frame;

(d) resilient means for urging said platform and said lower portion of said liner means in said upward direction to a position of equilibrium; and (e) actuation means responsive to said movement in a downward direction of said platform for actuating said musical means when said platform is not in said position of equilibrium, whereby upon deposit of said feces or urine within said liner means, said platform is urged downwardly in opposition to said resilient means thereby causing said musical means to sound musical tones.

2. The apparatus set forth in claim 1 wherein said platform means comprises a circular disc-shaped portion having an upper surface, a lower surface, and a cylindrical shaped rod projecting outwardly from said lower surface, the axis of said rod being substantially perpendicular to said upper surface.

3. The apparatus set forth in claim 2 wherein said upper surface is concave.

4. The apparatus set forth in claim 2 wherein said upper surface is substantially flat.

5. The apparatus set forth in claim 4 wherein said frame includes a bottom, a circular rim, and a plurality of spaced support ribs connecting said circular rim to said bottom thereby forming a substantially rigid basket like structure.

6. The apparatus set forth in claim 5 wherein said platform means includes an annular wall projecting downwardly from said bottom surface and arranged substantially concentric to said rod.

7. The apparatus set forth in claim 6 wherein said resilient means comprises a helical compression spring having an end which loosely engages said annular wall so that said spring is constrained and substantially concentric to said rod.

8. The apparatus set forth in claim 7 wherein said bottom of said frame includes a centrally positioned boss having a hole therethrough and said rod of said platform means projects through said hole, said hole being sized to permit sliding longitudinal movement of said rod therein and thereby constraining said upward and downward movements of said platform means to movements in a direction perpendicular to said top surface of said platform means.

9. In a musical potty chair having a seat for supporting the weight of a child and musical means for sounding musical tones upon actuation thereof, and a receptacle means removably attached to said seat for receiving excrement including feces and urine and being responsive to the weight of said excrement exclusive of said weight of said child for effecting said actuation of said musical means comprising:

(a) a frame comprising a bottom, a circular rim, and a plurality of spaced support ribs connecting said circular rim to said bottom thereby forming a substantially rigid basket like structure, said bottom including a centrally positioned boss having a hole formed therethrough;

(b) a liner means for forming a liquid containing membrane within said frame, said liner means having a lower portion and an upper portion, said upper portion being supported by said frame;

(c) a platform means comprising a circular shaped disc portion having an upper surface for supporting said lower portion of said liner means, a lower surface, and a cylindrically shaped rod projecting outwardly from said lower surface and through said hole of said boss, the major axis of said rod being perpendicularly to said upper surface and an annular wall projecting downwardly from said lower surface and arranged substantially concentric to said rod, said hole of said boss being sized to permit sliding longitudinal movement of said rod therein, wherein said platform means is arranged to undergo linear movement in an upward direction and a downward direction with respect to said frame;

(d) a helical compression spring having an end which loosely engages said annular wall so that said spring is constrained and substantially concentric to said rod and arranged to urge said platform and said lower portion of said liner means in said upward direction to a position of equilibrium; and (e) means responsive to said movement in a downward direction of said platform for effecting said actuation of said musical means when said platform is not in said position of equilibrium.

whereby upon deposit of said feces or urine within said liner means, said platform is urged downwardly in opposition to said resilient means thereby causing said musical means to sound musical tones.

* * * * *